US005740853A

United States Patent [19]

Tsuchihashi et al.

[11] Patent Number: 5,740,853

[45] Date of Patent: Apr. 21, 1998

[54] PROCESS AND APPARATUS FOR ONLINE-COILING QUENCH-SOLIDIFIED MAGNETIC STRIP

[75] Inventors: Soshichi Tsuchihashi; Masayoshi Tatsukawa; Minoru Yamate, all of Futtsu; Hiroaki Sakamoto, Kawasaki; Yuichi Sato, Futtsu, all of Japan

[73] Assignee: Nippon Steel Corporation, Tokyo, Japan

[21] Appl. No.: 584,513

[22] Filed: Jan. 11, 1996

[30] Foreign Application Priority Data

Jan. 11, 1995 [JP] Japan ..... 7-002873
Mar. 23, 1995 [JP] Japan ..... 7-064263

[51] Int. Cl.[6] ..... B22D 11/06

[52] U.S. Cl. ..... 164/463; 164/423; 164/477

[58] Field of Search ..... 164/463, 423, 164/502, 429, 466, 477, 479

[56] References Cited

FOREIGN PATENT DOCUMENTS 57-94453 6/1982 Japan .
5-123744 5/1993 Japan .

*Primary Examiner*—Joseph J. Hail, III
*Assistant Examiner*—I.-H. Lin
*Attorney, Agent, or Firm*—Kenyon & Kenyon

[57] ABSTRACT

To solve the problem of capturing the strip leading edge for improving the success rate of coiling and to eliminate the complicated recovery of the coiled strip for improving the productivity, a process of online-coiling a quench-solidified magnetic strip produced by ejecting a liquid metal or metal alloy onto a moving cooled substrate comprises the step of rotating a coiling roll having a magnetized surface to coil the strip therearound, at a coiling roll surface speed within the range of not less than 90% and less than 100% of a moving speed of the substrate, upon starting the coiling.

4 Claims, 4 Drawing Sheets

PROCESS AND APPARATUS FOR ONLINE-COILING QUENCH-SOLIDIFIED MAGNETIC STRIP

BACKGROUND OF THE INVENTION

1. Field of the Invention

The present invention relates to a process and an apparatus for online-coiling a quench-solidified magnetic strip immediately after the production thereof in a liquid quench process in which a liquid metal or metal alloy (hereinafter simply referred as "molten metal") is quench-solidified on a moving cooled substrate to produce a strip metal or metal alloy.

2. Description of the Related Art

The liquid quench processes include a single roll process, in which a molten metal is supplied onto a single fast rotating cooling roll to produce a strip, and a twin roll process, in which a molten metal is supplied between a pair of fast rotating cooling rolls to produce a strip.

FIG. 1 shows a liquid quench process to produce a strip by using a single roll quench-solidifying strip production apparatus. A molten metal 7 is supplied to a tundish 4 to a fixed molten metal level. A tuyere brick 9 provided in the bottom of the tundish 4 is connected to an intermediate nozzle 10 and a nozzle holder 11. The tuyere brick 9, the intermediate nozzle 10 and the nozzle holder 11 have through holes connected to each other to form a molten metal conduit 14 and an enlarged inner space 15 in the nozzle holder 11. A nozzle chip 12 attached to the tip of the nozzle holder 11 has a nozzle slit 13 extending therethrough and communicated with the conduit 14. Referring to FIG. 2, the enlarged inner space 15 in the nozzle holder 11 is defined as a portion of the conduit 14 that is located in the nozzle holder 11 and has an enlarged section to provide a wide strip. The nozzle slit 13 is an opening extending through the nozzle chip 12 to eject the molten metal 7 out of the tundish 4.

By raising a stopper 8, the molten metal 7 is allowed to flow out of the tundish 4 through the conduit 14 and the nozzle slit 13 toward a cooling roll 3, during which the molten metal 7 flows through the nozzle slit 13 toward the cooling roll 3 at a controlled flow rate in accordance with a static pressure of the molten metal 7 in the tundish 4. The molten metal 7 ejected through the nozzle slit 13 is rapidly cooled or quenched on the surface of the cooling roll 3 to form a strip 2.

It is noted that, in FIG. 1, the cooling roll 3 is shown at a further reduced scale than the tundish 4 for clarification.

Many processes have been proposed to online-coil, or coil in an online manner, a strip produced by the liquid quench process immediately after the production. In all of these processes, coiling of the strip is basically performed by rotating a coiling roll to coil the strip therearound and it is essential to capture the strip, on the coiling roll, upon starting the coiling. For a magnetic strip, Japanese Unexamined Patent Publication (Kokai) No. 57-94453, for example, proposed a process in which a coiling roll has pieces of a permanent magnet embedded in the surface thereof to capture the strip and is rotated to coil the strip therearound.

In the above-recited process, a molten metal is quench-solidified on a rotating cooled substrate to form a strip, the strip adhered to and rotating with the roll surface is then separated from the roll surface by a sharpened jet of a pressurized gas, the leading edge of the separated strip is then magnetically attracted to a coiling roll having a magnetized surface and rotating at a circumferential speed of not less than that of the rotating cooled substrate, and the strip is continuously coiled on the coiling roll. It is also disclosed that the coiling roll may have pieces of a permanent magnet such as an REM-cobalt magnet embedded in the surface of the coiling roll.

The inventors attempted to online-coil a magnetic strip produced by a single roll liquid quench process.

As a result, although a solidified strip was successfully separated from the surface of a cooling roll by a pressurized gas jet, the leading edge of the separated strip was captured at as low a success rate as about 30%, and when capture failed, the strip production could not be continued. Thus, the failure in capturing the strip leading edge must be prevented in order to ensure a good yield of the strip.

There is another problem of recovering the coiled strip in that, because the coiled strip is magnetized by the permanent magnet embedded in the coiling roll and is attracted to the coiling roll, it is difficult to remove the coiled strip from the coiling roll. This problem is serious for the strip turns near the surface of the coiling roll, and about ten initial turns are very difficult to be removed, so that the strip recovery operation is complicated. Such a complicated strip recovery is undesirable because it causes excess time consumption and lowers the productivity.

SUMMARY OF THE INVENTION

The object of the present invention is to provide a process and an apparatus for coiling a magnetic strip using a coiling roll having a magnetized surface, in which the problem of capturing the strip leading edge is solved to improve the success rate of coiling and the complicated recovery of the coiled strip is eliminated, thereby improving the productivity.

To achieve the above object, the present invention provides a process of online-coiling a quench-solidified magnetic strip produced by ejecting a liquid metal or metal alloy onto a moving cooled substrate, comprising the step of:

rotating a coiling roll having a magnetized surface to coil the strip therearound, at a coiling roll surface speed within the range of not less than 90% and less than 100% of a moving speed of the substrate, upon starting the coiling.

The process preferably further comprises the step of:

energizing, upon starting the coiling, segments of an electromagnet embedded in the surface of the coiling roll to hold the strip on the surface of the coiling roll by attracting the strip to the surface of the coiling roll by a magnetic attraction force exerted by the electromagnets.

The present invention also provides an apparatus for online-coiling a quench-solidified magnetic strip produced by ejecting a liquid metal or metal alloy onto a moving cooled substrate, comprising:

a coiling roll rotatable to coil the strip therearound and having segments of an electromagnet embedded in a surface, thereof.

DESCRIPTION OF THE PREFERRED EMBODIMENTS

Figure 1:
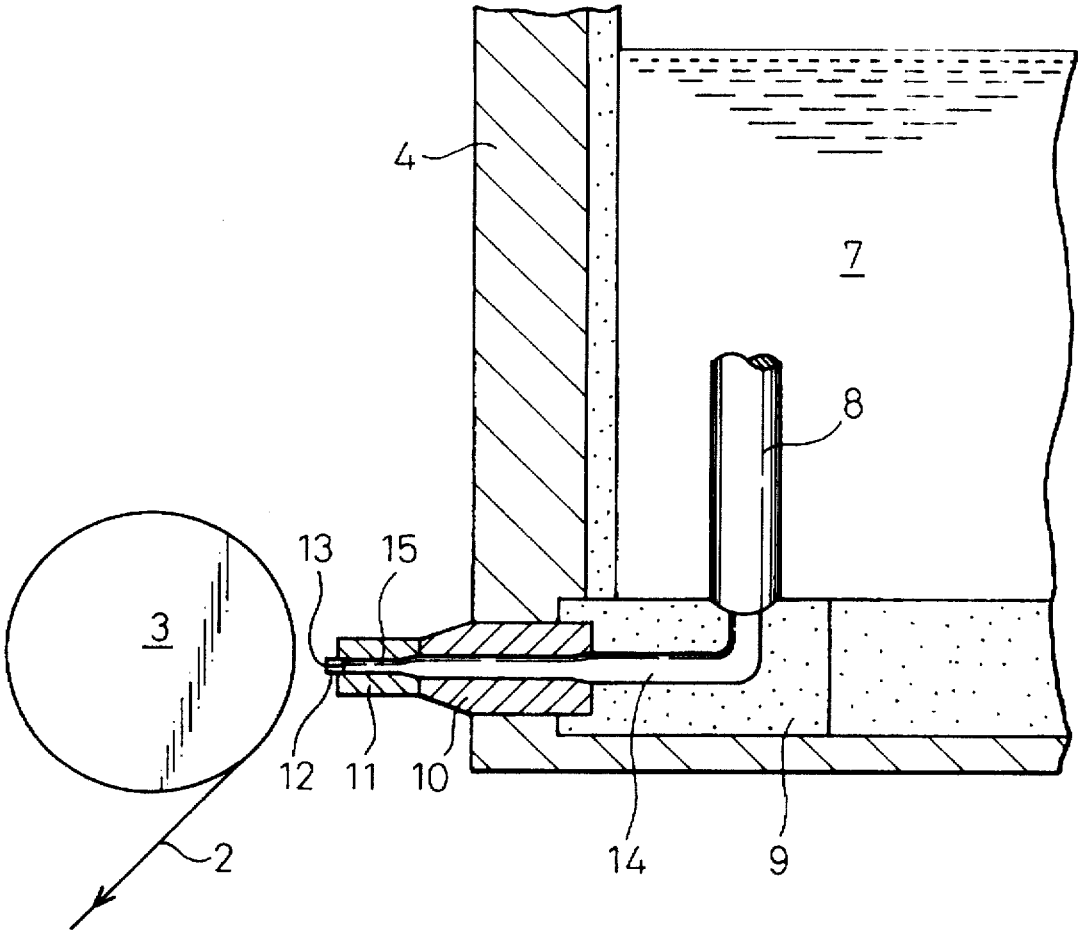
FIG. 1 is a cross-sectional view schematically illustrating an arrangement for producing a strip by a conventional single roll liquid quench process.
Figure 2:
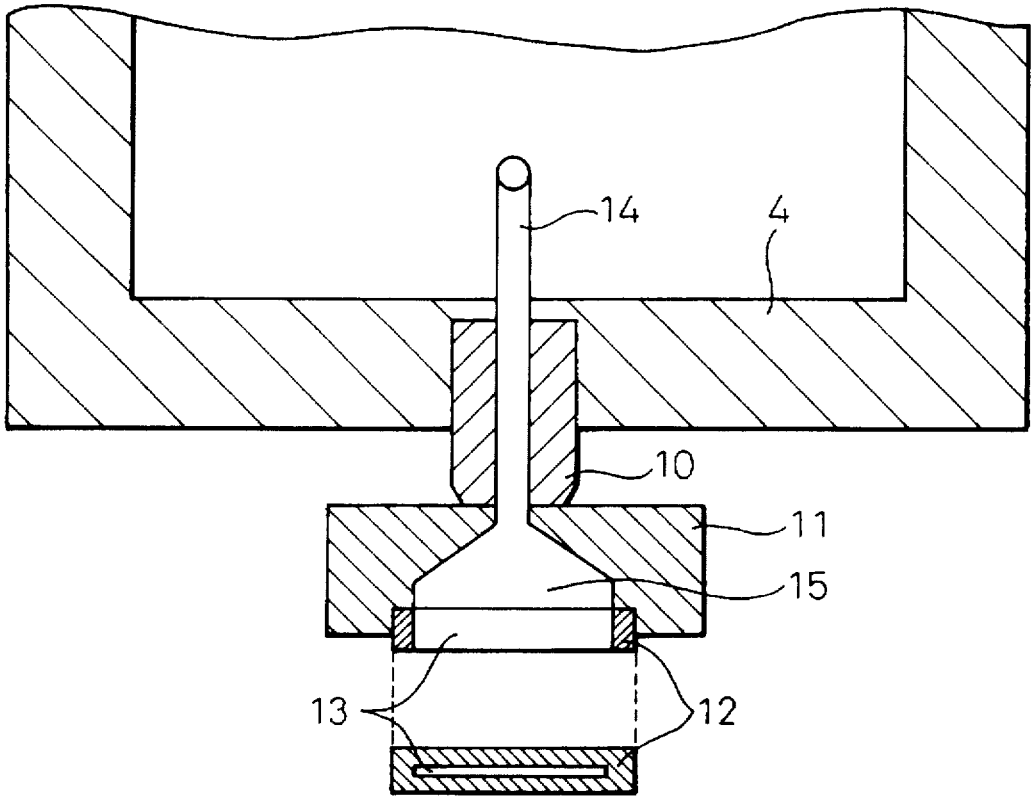
FIG. 2 is an enlarged cross-sectional view of a portion around a nozzle holder of the arrangement shown in FIG. 1.
Figure 3:
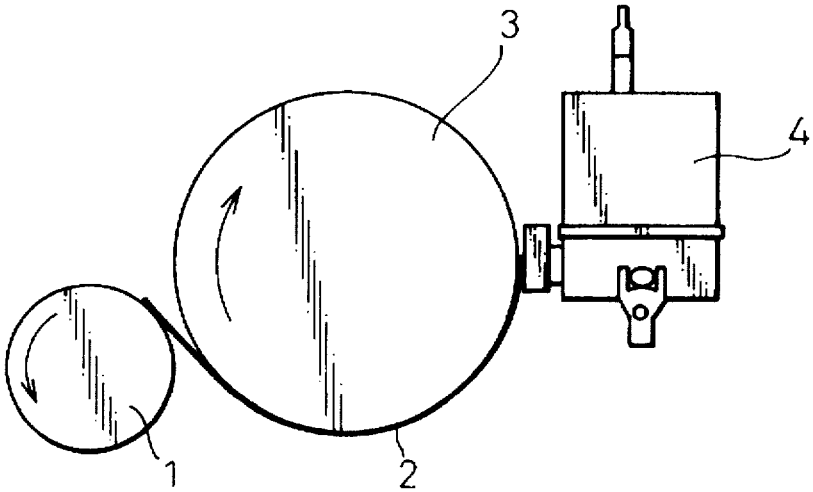
FIG. 3 is a front view showing an arrangement for coiling a quench-solidified strip according to the present invention.

To capture the leading edge of a quench-solidified strip, the coiling roll must be rotated at a circumferential or surface speed within the range of not less than 90% and less than 100% of that of the cooling roll. Referring to FIG. 3, a molten metal held in a tundish 4 is ejected onto the circumferential surface of a cooling roll 3 to form a strip 2, which is then coiled by a coiling roll 1. If the coiling roll is rotated at a surface speed of 100% or more of that of the cooling roll, the leading edge of the quench-solidified strip is not stably captured by the cooling roll surface. The present inventors conducted experiments and found that the success rate of capturing the strip leading edge is at most 30% when the coiling roll is rotated at a surface speed of 100% or more of that of the cooling roll. A video tape observation showed that, if the surface speed of the coiling roll is 100% or more of that of the cooling roll, the strip leading edge is instantaneously captured by the coiling roll, but immediately thereafter, the strip is broken with the result that, consequently, the strip is not stably captured.

This is because a tensile force is exerted on the strip immediately after the leading edge is captured by the coiling roll when the surface speed of the coiling roll is 100% or more of that of the cooling roll. Specifically, the strip is not generally broken by a substantial tensile force, but is easily broken in the leading edge, which usually has a small thickness or contains defects causing the strip to be easily broken by a small tensile force. Therefore, even though the strip leading edge is once captured, the strip is broken immediately thereafter because of a tensile force, if the surface speed of the coiling roll is 100% or more of that of the cooling roll.

The surface speed of the coiling roll must not be less than 90% of that of the cooling roll. At smaller surface speeds of the coiling roll, the success rate of capturing the strip leading edge is as low as about 60%, and also, a coil collapse occurs during coiling. When the surface speed of the coiling roll is less than 90% of that of the cooling roll, even if the leading edge is successfully captured, the following strip portion is loosely coiled to cause a coil collapse to occur as the number of turns of the coiled strip is increased. The coil collapse is practically undesirable because it causes the strip to be broken and the strip casting cannot continue.

Figure 4:
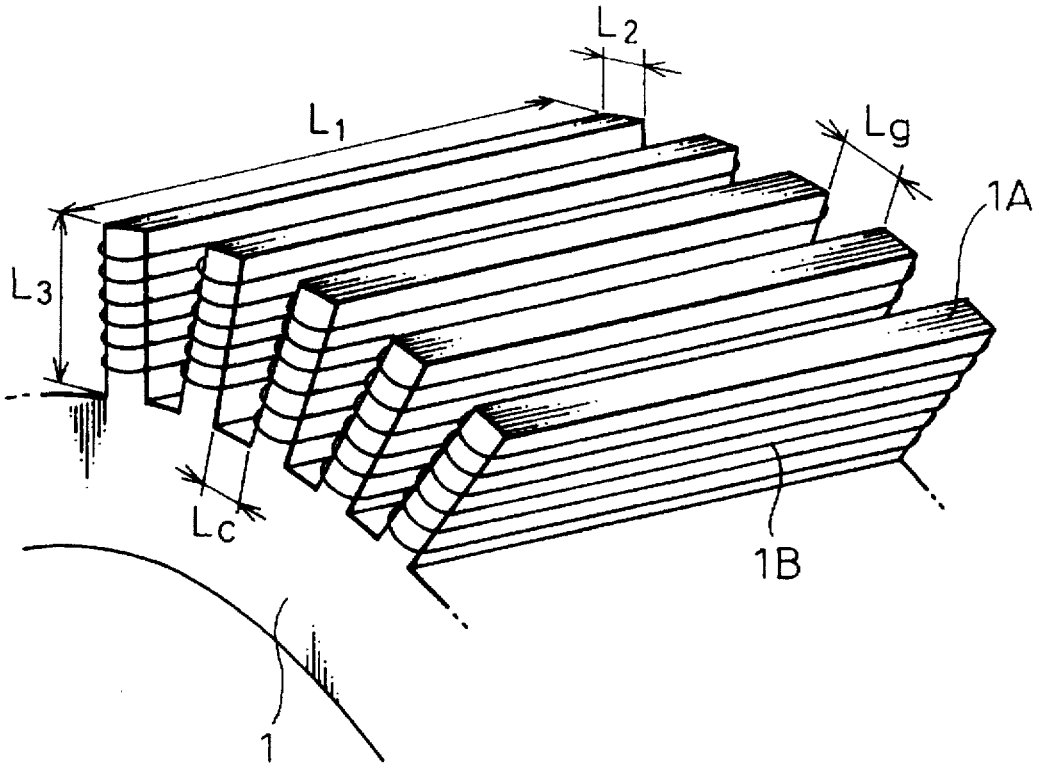
FIG. 4 is an enlarged perspective view showing segments of an electromagnet provided along the circumference of a coiling roll according to the present invention.

The coiling roll according to the present invention preferably has an electromagnet embedded in the surface thereof. For example, as shown in FIG. 4, the electromagnet embedded in the surface of the coiling roll comprises segments each of which is composed of a magnet core 1A and a magnet coil 1B. The segments of the magnet core 1A are provided along the circumference of the coiling roll at an interval Lc or Lg. The segments of the core 1A have a magnet coil 1B of an enameled wire wound therearound in alternating senses to provide alternate magnetic poles from segment to segment.

The coiling roll may have a permanent magnet embedded in the surface thereof.

To ensure stable coiling of the strip according to the present invention, the electromagnet of the coiling roll preferably provides a magnetic flux density of 0.1 T (tesla) or more. At lower flux densities, the attraction force exerted by the electromagnet is too weak to ensure capturing the strip leading edge and stable coiling of the strip. Preferred conditions including the length $L_1$, width $L_2$, and height $L_3$ of the segments will be specifically described later in Examples.

Figure 5:
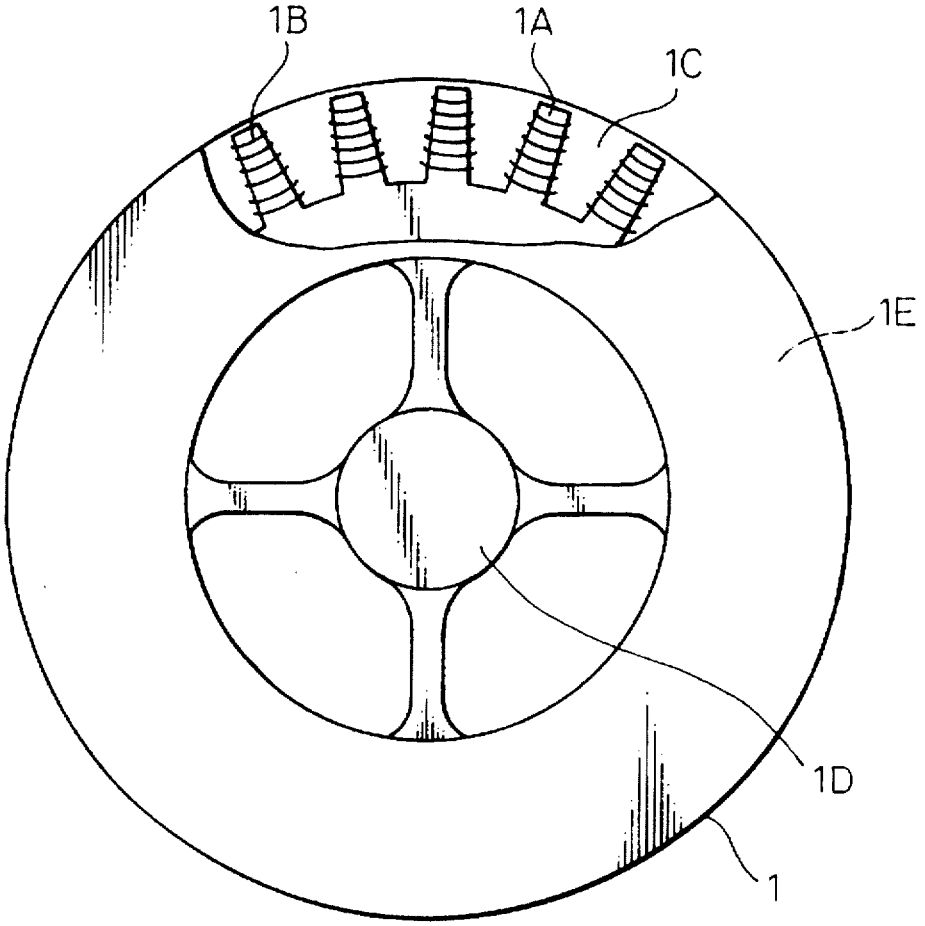
FIG. 5 is a front and partially broken view of a coiling roll having segments of an electromagnet according to the present invention.

As shown in FIG. 5, a coiling roll 1 according to the present invention may be composed of the coiling roll shown in FIG. 4 fitted with a rotatable shaft 1D and may have a surface impregnated with a resin 1C to protect the electromagnet including the core 1A and the wire coil 1B. It is also preferable to provide a cover 1E to cover and protect the end surface of the coiling roll 1.

The mechanism for driving a coiling roll is not limited but may be an electric motor or other means conventionally used to drive a coiling roll. The dimensions of a coiling roll is not limited but may be substantially similar to those of the conventional coiling rolls.

Electric power may be supplied to the electromagnet in the surface of the coiling roll through an electric cable provided in the rotating shaft fitted with the coiling roll and the electric power may then be supplied from the shaft to the wire coils 1B through a face contact at a fitting surface.

Upon capturing the strip leading edge, the coiling roll and the cooling roll are preferably as possible as close to each other as long as they are not in contact with each other, for example, at a distance of about 10 mm or less. However, once the strip leading edge is captured and a stable coiling starts, the coiling roll must be moved away the cooling roll in consideration that the coil diameter is increased as the coiling process proceeds. The timing at which the coiling roll is moved away will be specifically described later in Examples.

After the strip leading edge is captured and a stable coiling starts, the surface speed of the coiling roll is preferably increased to a value a little greater than that of the cooling roll to impart an appropriate level of a tensile force to the strip being coiled. This prevents a coil collapse from occurring due to a loose coiling which would otherwise occur because the surface speed of the coiling roll is a little less than that of the cooling roll until the strip leading edge is captured. As herein aforementioned, the strip is easily broken in the leading edge portion but can bear a substantial tensile force in the other portion. Preferred values of the tensile force to be applied to the strip will be later described in Example.

Figure 6:
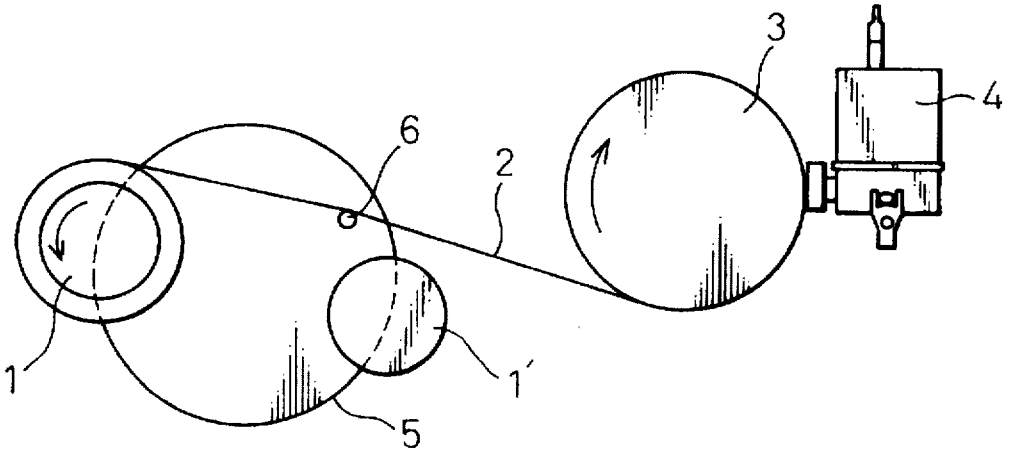
Fig. 6 is a front view showing an arrangement for coiling a quench-solidified strip metal according to the present invention.

To manufacture a strip in a large scale according to the present invention, an arrangement shown in FIG. 6 may be advantageously used to cope with an occasion in which a single coiling roll is filled up with the strip and cannot accept the subsequent strip. The arrangement shown in FIG. 6 includes a rotary disc 5 holding the axes of a coiling roll or reel 1 and an additional coiling roll or reel 1' in operating and waiting positions, respectively. This arrangement also includes a support roller 6 to ensure stable coiling when the strip forms a long path line as shown in FIG. 6.

The present invention is advantageously applied not only to the above-mentioned single roll process but also to any of other liquid quench processes, including a twin roll process in which a molten metal is supplied between a pair of rotating cooled substrates, or cooling rolls, to form a strip.

Preferred casting conditions to form a strip will be later described in the Examples.

EXAMPLES

The present invention will be described with reference to the attached drawings.

Example 1

A coiling process according to the present invention was carried out in combination with a process of producing or casting a strip of an Fe—$Si_{6.5}$—$B_{12}$—$C_1$ amorphous alloy using an open-air single roll strip production apparatus. The casting was carried out by using a molten sample ejection nozzle chip having an nozzle opening of 1.2 mm×150 mm. An amount of molten sample was prepared by induction melting, ejected at a rate of 50 kg/min, and sprayed onto the circumferential surface of a cooper cooling roll to form strip. The cooling roll was rotated at a surface speed of 28 m/sec.

As shown in FIG. 4, the coiling apparatus used included a coiling roll 400 mm in diameter having segments of an electromagnet formed in the circumferential surface with the remaining spaces filled with a resin to embed the segments and flatten the circumference surface. The magnet cores 1A of the electromagnet were made of JIS SS400 steel, had a length $L_1$ of 150 mm, a width $L_2$ of 10 mm, and a height $L_3$ of 50 mm, and disposed at an inner interval $L_c$ of 30 mm and an outer interval $L_g$ of 40 mm. Each of the magnet cores 1A had a 950 turn enameled wire coil 1B wound therearound. The wire coils 1B were wound in alternate senses from core to core. As shown in FIG. 5, the coiling roll 1 of JIS SS400 steel was fitted with and fixed to a roll shaft 1D for use in the practical production process.

The coiling roll was rotated at three levels of surface speeds of 25.2 m/sec, 26.5 m/sec, and 27.8 m/sec, with the other conditions remained constant. The casting and coiling process was carried out in ten runs for each level of the surface speed.

Upon capturing the strip leading edge, the coiling roll, the cooling roll, and the strip were positioned as shown in FIG. 3, and specifically, the coiling roll was located so that its axis took a position 150° turned clockwise from the line extending through the axis of the cooling roll and the nozzle chip ejecting the molten sample. Before starting the coiling, a current of 5A was supplied to the magnetic coils of the coiling roll. After 0.5 sec from the start of coiling, the rotation speed of the coiling roll was adjusted so that a load of 2.5 kgf was applied to the strip being coiled. After 2 sec from the start of coiling, the current applied to the magnetic coils was switched off. The distance between the coiling roll and the cooling roll was initially 2 mm, and after 2 sec from the start of coiling, it was increased by retracting the coiling roll at a rate of 25 mm/sec for an interval of 10 sec.

The results are denoted by Nos. 1 to 3 in Table 1. When the surface speed of the coiling roll was 25.2 m/sec (see No. 1 in Table 1), eight runs were successfully performed with all the strips coiled without occurrence of a coil collapse, although, in the remaining two runs, the strip leading edge was not captured and the casting was interrupted. When the surface speed of the coiling roll was 26.5 m/sec or 27.8 m/sec (see Nos. 2 and 3 in Table 1), all runs were successfully performed with all the strip coiled without occurrence of a coil collapse. This shows that the strip leading edge was successfully captured in 28 runs of 30 runs, indicating a high success rate of more than 90%. After the casting and coiling process was completed, the coiled strips were easily recovered by a recoiler because the coiled strips were not magnetized any longer.

All of the 28 runs produced good strips having a width of about 150 mm and a thickness of about 30 μm.

Example 2

A coiling process according to the present invention was carried out in combination with a process of producing or casting a strip of an Fe—$Si_{6.5}$—$B_{12}$—$C_1$ amorphous alloy using the same open-air single roll strip production apparatus as used in Example 1. The cooling roll was rotated at a surface speed of 20 m/sec. The other casting conditions were the same as in Example 1.

The coiling was started by rotating the coiling roll at surface speeds of 18.5 m/sec and 19.5 m/sec. The casting and coiling process was performed in ten runs for each surface speed. The other coiling conditions were the same as in Example 1.

The results are denoted by Nos. 4 and 5 in Table 1. In all of the 20 runs, all the strips were successfully coiled without occurrence of a coil collapse. This shows that the strip leading edge was successfully in all of the 20 runs, indicating a high success rate of 100%. After the casting and coiling process was completed, the coiled strips were easily recovered by a recoiler because the coiled strips were not magnetized any longer.

All of the 20 runs produced good strips having a width of about 150 mm and a thickness of about 40 μm.

Comparative Examples

A coiling process was carried out in combination with a process of producing or casting a strip of an Fe—$Si_{6.5}$—$B_{12}$—$C_1$ amorphous alloy using the same open-air single roll strip production apparatus as used in Example 1. The casting conditions were the same as in Example 1.

The coiling was started by rotating the coiling roll at surface speeds of 23 m/sec, 24.5 m/sec, 28 m/sec and 29 m/sec. The casting and coiling process was performed in five runs for each surface speed. The other coiling conditions were the same as in Example 1.

The results are denoted by Nos. 6 to 9 in Table 1. When the surface speed of the coiling roll was 23 m/sec or 24.5 m/sec (see Nos. C6 and C7 in Table 1), the strip leading edge was successfully captured in three runs for each level of the surface speed, but in the other two runs, the capturing of the strip leading edge failed and the casting was interrupted for both levels of the surface speed. When the surface speed of the coiling roll was 23 m/sec (see No. C6 in Table 1), although the strip leading edge was successfully captured in three runs, a coil collapse occurred during coiling in two runs and caused breakage of the strip to occur, so that the casting could not be continued further.

When the surface speed of the coiling roll was 28 m/sec (see No. C8 in Table 1), the strip was entirely coiled in two runs, but in the other three runs, the capturing of the strip leading edge failed and the casting was interrupted. When the surface speed of the coiling roll was 29 m/sec (see No. C9 in Table 1), the strip was entirely coiled only in one run, but in the other four runs, the capturing of the strip leading edge failed and the casting was interrupted.

| | Coiling Conditions | | | Results | |
|---|---|---|---|---|---|
| | Roll Surface Speed (m/sec) | | | Percentage of | |
| No. | Coiling at Start (A) | Cooling (B) | Percentage (A/B × 100) | Capturing Succeeded | Final Coiling |
| 1 | 25.2 | 28.0 | 90.0 | 80 | Succeeded except for 2 runs |
| 2 | 26.5 | " | 94.6 | 100 | Succeeded in all runs |
| 3 | 27.8 | " | 99.3 | 100 | Succeeded in all runs |
| 4 | 18.5 | 20.0 | 92.5 | 100 | Succeeded in all runs |
| 5 | 19.5 | " | 97.5 | 100 | Succeeded in all runs |
| C6 | 23.0 | 28.0 | 82.1 | 60 | Collapse in 2 runs |
| C7 | 24.5 | " | 87.5 | 60 | Capturing Succeeded in Poor Percentage |
| C8 | 28.0 | " | 100.0 | 40 | Capturing Succeeded in Poor Percentage |
| C9 | 29.0 | " | 103.6 | 20 | Capturing Succeeded in Poor Percentage |

[Note]
Nos. 1–5: samples according to the present invention.
Nos. C6–C9: comparative samples.

The online coiling of a strip is essential to the manufacture of quench-solidified strips of, for example, an amorphous alloy in an industrial scale. According to the present invention, the strip leading edge is successfully captured upon start of the coiling with no substantial problem to enable the strips to be manufactured with a high production yield.

The coiling roll according to the present invention has segments of an electromagnet embedded in the surface thereof, so that the electromagnet can be switched off upon recovery of the coiled strip, which is thus not magnetized any longer to eliminate a complicated operation conventionally necessary for strip recovery. This improves the productivity of the strips and enables economical production of the strips.

We claim:

1. A process for online-coiling of a quench-solidified magnetic strip comprising:

providing a moving cooling substrate moving at a selected speed;

ejecting a liquid metal or a liquid metal alloy onto said moving cooling substrate thereby quench solidifying said ejected liquid metal or liquid metal alloy into a solidified metal strip, said solidified metal strip having a leading edge;

removing said solidified metal strip from said moving cooling substrate;

providing a rotating coiling roll adjacent said moving cooling substrate, said rotating coiling roll having a circumferential surface;

magnetizing said circumferential surface of said coiling roll;

rotating said coiling roll to cause said magnetized circumferential surface to move at a speed of not less than 90% and less than 100% of said moving cooling substrate moving speed;

capturing said leading edge of said solidified metal strip removed from said moving cooling substrate using magnetic attraction force provided by said magnetized circumferential surface of said rotating coiling roll when said magnetized circumferential surface is moving at said speed of not less than 90% and less than 100% of said moving cooling substrate moving speed, thereby commencing coiling of said solidified metal strip on said circumferential surface of said rotating coiling roll.

2. The process according to claim 1 wherein after capture of said leading edge of said solidified metal strip and commencement of coiling of said solidified metal strip, said process further comprising:

changing speed of rotating said coiling roll to provide said circumferential surface with a speed greater than said moving cooling substrate moving speed, thereby providing tension on said solidified metal strip being coiled.

3. The process according to claim 1 further comprising:

embedding segments of an electromagnet in said circumferential surface of said coiling roll; and energizing said electromagnetic segments to provide said magnetic attraction force of said magnetized circumferential surface of said coiling roll for capturing said leading edge of said solidified metal strip.

4. An apparatus for online-coiling of a quench-solidified magnetic strip comprising;

a cooling substrate mounted for movement;

means for ejecting a liquid metal or a liquid metal alloy onto said cooling substrate;

a coiling roll mounted for rotation disposed adjacent to said cooling substrate, said coiling roll having a circumferential surface for receiving and coiling a metal strip solidified on said cooling substrate;

segments of an electromagnetic embedded along said circumferential surface of said coiling roll for providing a magnetic attraction force for capturing said metal strip.

* * * * *

UNITED STATES PATENT AND TRADEMARK OFFICE

CERTIFICATE OF CORRECTION

PATENT NO. : 5,740,853
DATED : April 21, 1998
INVENTOR(S) : Soshichi TSUCHIHASHI, et al.

It is certified that error appears in the above-identified patent and that said Letters Patent is hereby corrected as shown below:

Column 2, line 60, delete the comma after "surface".

Column 4, line 21, change "is" to --are--.

Column 4, line 31, delete "possible as".

Column 4, line 32, after "other" at beginning of line insert --as possible--.

Column 4, line 35, after "away" insert --from--.

Column 4, line 52, change "Example." to --Examples.--.

Column 5, line 14, change "an nozzle" to --a nozzle--.

Column 5, line 17, change "cooper" to --copper--.

Column 6, line 24, after "successfully" insert --captured--.

UNITED STATES PATENT AND TRADEMARK OFFICE

CERTIFICATE OF CORRECTION

PATENT NO. : 5,740,853

DATED : April 21, 1998

INVENTOR(S) : Soshichi TSUCHIHASHI, et al.

It is certified that error appears in the above-identified patent and that said Letters Patent is hereby corrected as shown below:

Column 8, line 7, after "adjacent" insert --to--.

Signed and Sealed this

Thirteenth Day of July, 1999

*Attest:*

*Attesting Officer*

Q. TODD DICKINSON

*Acting Commissioner of Patents and Trademarks*